United States Patent [19]

Lau

[11] Patent Number: 4,566,158

[45] Date of Patent: Jan. 28, 1986

[54] ADJUSTABLE BUCKLE

[76] Inventor: Wah Lau, 41-31 149th Pl., Flushing, N.Y. 11355

[21] Appl. No.: 661,450

[22] Filed: Oct. 16, 1984

Related U.S. Application Data

[63] Continuation-in-part of Ser. No. 557,059, Dec. 1, 1983.

[51] Int. Cl.[4] ..... A41F 1/00; A44B 11/10

[52] U.S. Cl. ..... 24/580; 24/163 K; 24/171; 24/303; 24/573; 2/235; 2/236

[58] Field of Search ..... 24/163 K, 171, 180, 24/303, 580, 573, 572, 578; 2/235, 236

[56] References Cited

U.S. PATENT DOCUMENTS

| | | | |
|---|---|---|---|
| 63,782 | 4/1867 | Caldwell | 24/171 |
| 82,142 | 9/1868 | McDonald | 24/580 |
| 181,188 | 8/1876 | Lascell | 24/580 |
| 390,848 | 10/1888 | Farrell | 24/573 |
| 824,745 | 7/1906 | Salisbury | 2/236 |
| 849,677 | 4/1907 | Grote | 2/236 |
| 878,996 | 2/1908 | Pasley | 24/180 |
| 1,134,016 | 3/1915 | Sanders | 24/163 K |
| 1,820,918 | 9/1931 | Mackenzie | 24/580 |
| 2,290,573 | 7/1942 | Rasp | 24/171 |
| 2,455,236 | 11/1948 | Darvie et al. | 24/580 |
| 2,475,226 | 7/1949 | Ellis | 24/303 |
| 3,063,118 | 11/1962 | Salter et al. | 24/303 |
| 3,114,186 | 12/1963 | Olsen | 24/573 |
| 3,192,747 | 7/1965 | Stupell et al. | 24/303 |
| 4,429,439 | 2/1984 | Waugh | 2/235 |

*Primary Examiner*—Victor N. Sakran

*Attorney, Agent, or Firm*—Lackenbach Siegel Marzullo Presta & Aronson

[57] ABSTRACT

An adjustable buckle having elements for fixing to respective opposed flaps of a garment with a cover formed to engage one element and in pulling the respective flap of the one element over the respective of the second element to engage the second element in a plurality of positions so that the flaps are secured and the garment buckled in a plurality of positions so as to adjust the garment on the body of the wearer. The buckle is particularly suited for closing pants, and eliminating the top button closure on the pants over the fly. The buckle eliminates the need for belts and provides a flat, contoured appearance to the pants.

9 Claims, 20 Drawing Figures

ADJUSTABLE BUCKLE

RELATED U.S. PATENT APPLICATIONS

This application is a continuation-in-part application of U.S. Ser. No. 557,059, filed Dec. 1, 1983.

FIELD OF THE INVENTION

This invention relates to adjustable buckles. Specifically this garment relates to an adjustable buckle for closing a garment or like object in a plurality of positions.

BACKGROUND AND DISCUSSION OF THE PRIOR ART

Heretofore, buttons, snaps or like closures were used to close the flaps of a garment such as pants or jeans above the fly portions. This conventional design required the presence of a belt to achieve a "finished" or aesthetically acceptable appearance.

With modern casual wear such pants or jeans are often worn without belts, and in closing the pants, the zipper of the fly is twisted and an esthetically undesirable bulge appears between the zippered portion and the button above the zipper.

Furthermore, without a belt there is no adjustable fitting of the garment to the girth of the wearer.

Now there is provided by the present invention an adjustable buckle which closes a garment to a plurality of fitting positions, eliminating the need for a belt and yet providing a smooth, adjusted, contoured fit to the wearer.

It is therefore a principal object of the present invention to provide a novel adjustable buckle.

It is a further object of the present invention to provide a buckle as aforesaid for multiple positioned closure of a garment.

DESCRIPTION OF THE PREFERRED EMBODIMENTS

Figure 1:
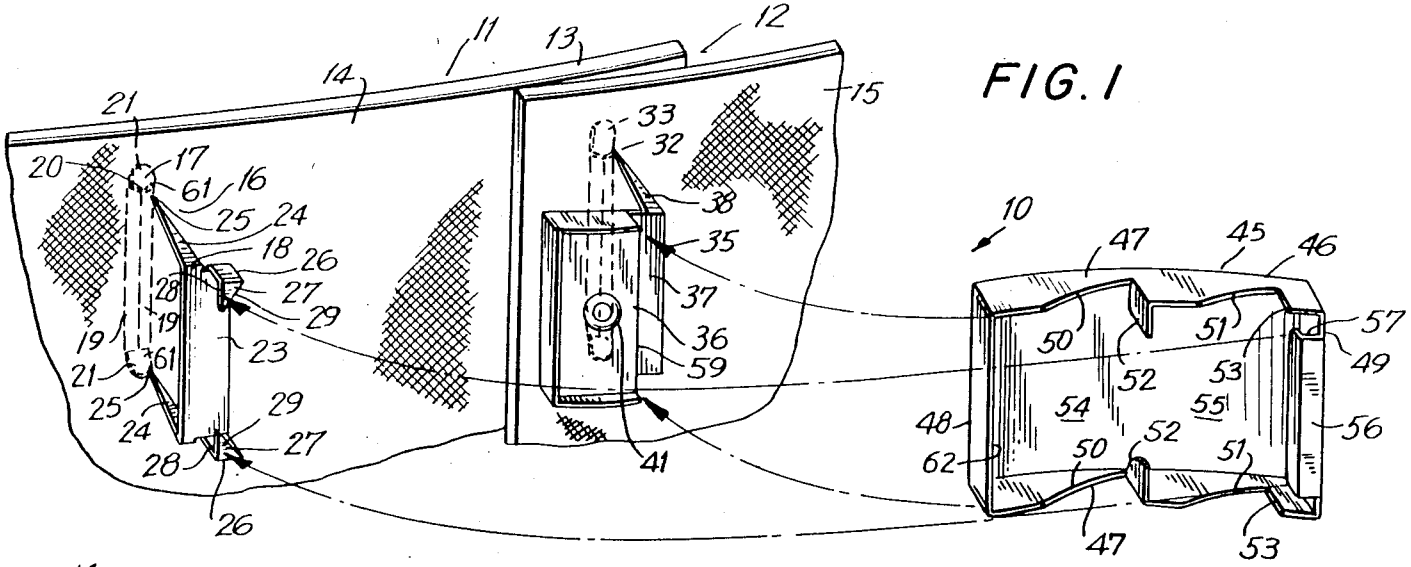
FIG. 1 is a perspective exploded view of a first embodiment of the buckle of the present invention assembled to the pants of the wearer.
Figure 2:
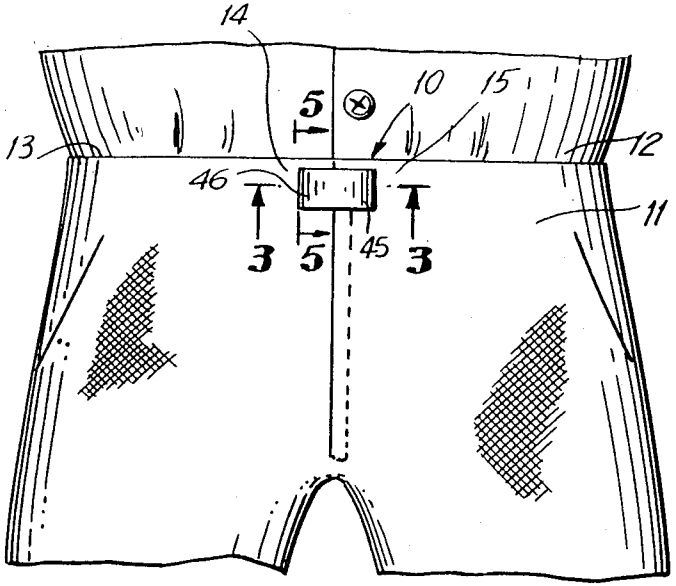
FIG. 2 is a front elevational view of the buckle of FIG. 1 in a closed pants position.

Referring to FIGS. 1–6, there is shown one embodiment of the present invention, namely, buckle 10.

A pair of pants or trousers 11 is shown having a waist portion 12 having top free edge 13 and overlapping flaps 14 and 15. Metal attachment element 16 is generally formed of a back plate 17 and fastener element 18. Plate 17 is formed with infolded portions 19 forming channel 20 and having oppositely disposed impact plate portions 21. Plate 17 is disposed so that infolded portions 19 are facingly disposed to the inside 22 of flap 14. Fastener element 18 is formed of a flat center member 23 having oppositely disposed downwardly depending tapered flanges 24 with sharp pointed edges 25. A pair of upwardly disposed angled flanges 26 are provided with topmost portions 27 having angled edges 28 and 29, for purposes hereinafter appearing.

Figure 3:
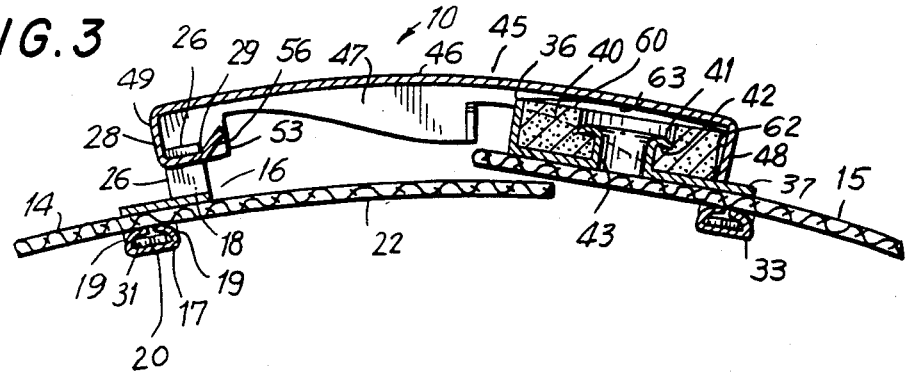
FIG. 3 is an enlarged sectional view taken along ling 3—3 of FIG. 2.
Figure 4:
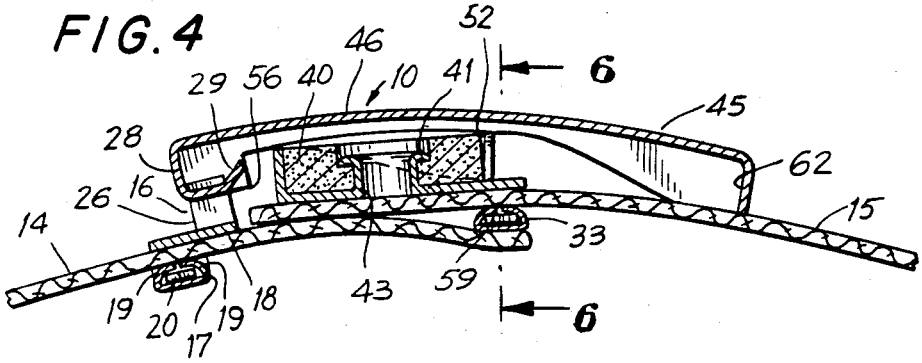
FIG. 4 is a view of the buckle as in FIG. 3 but in an adjusted second position.
Figure 5:
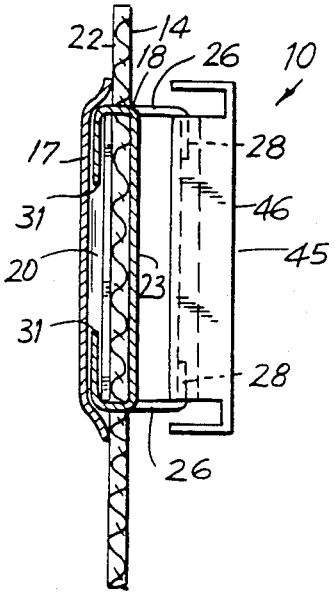
FIG. 5 is an enlarged sectional view taken along line 5—5 of FIG. 2.
Figure 6:
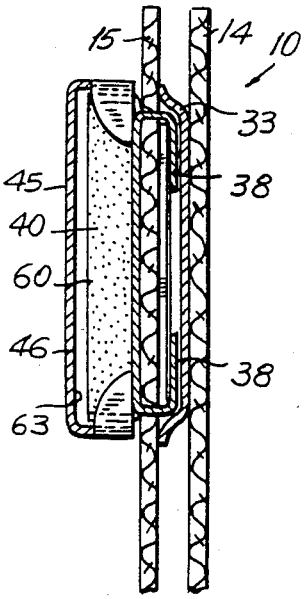
FIG. 6 is a sectional view taken along line 6—6 of FIG. 4.
Figure 7:
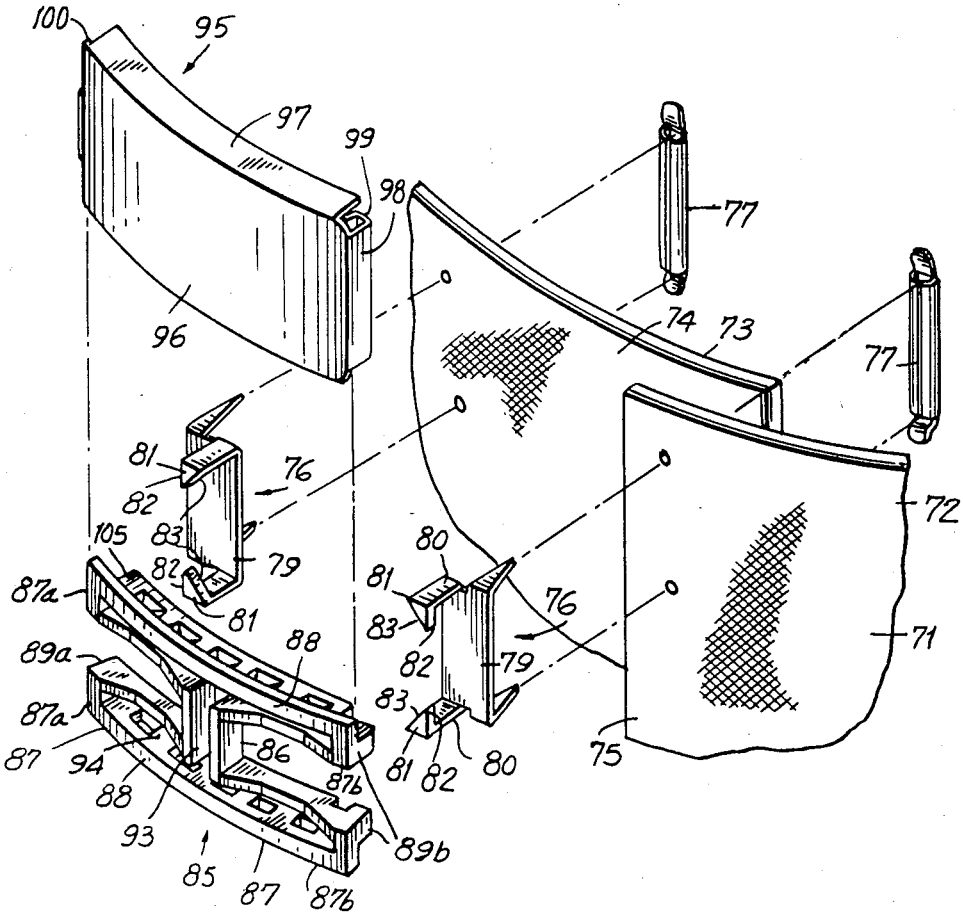
FIG. 7 is a persepctive exploded view of a second embodiment of the buckle of the present invention assembled to the pants of the wearer.
Figure 8:
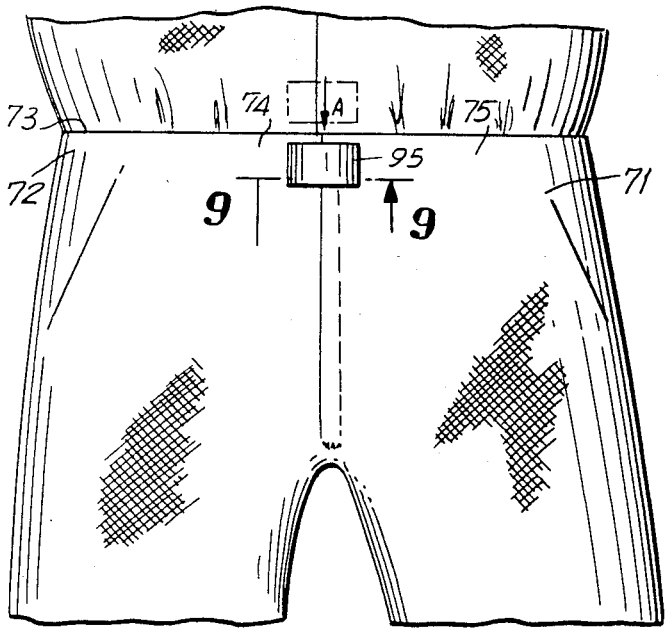
FIG. 8 is a front elevational view of the buckle of FIG. 7 in a pants closed position.
Figure 11:
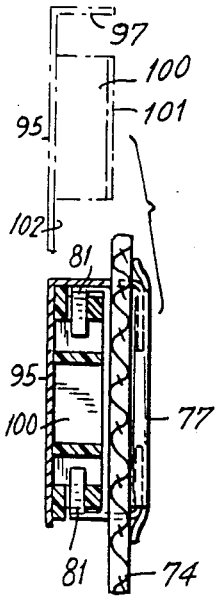
FIG. 11 is a sectional view taken along line 11—11 of FIG. 10 with a partially assembly of the metal overcap in broken line view.
Figure 9:
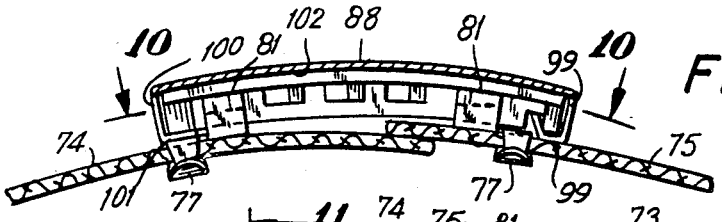
FIG. 9 is an enlarged sectional view taken along line 9—9 of FIG. 8.

Attachment element 16 is assembled to flap 14 by driving pointed edges 25 through the flap as at 29 to abut portions 21 so as to cause pointed flanges 24 to bend to a 90° corner as at 30 (FIG. 5) and reside in channel 20 as at 31 (FIGS. 3 and 4).

Metal attachment element 32 is formed of back plate 33, similar in construction to plate 17, and fastener assembly 35. Assembly 35 is formed of rectilinear housing 36 with central portion 37 and depending pointed edged flanges 38. Flanges 38 are similar in design and construction to tapered, pointed flanges 24, so that assembly 35 is mounted to flap 15 with plate 23 in a similar mounting to the mounting of element 18 to flap 4 through plate 17. A permanent magnet 40 is sized to fit into housing 36 and is held in place by grommet 41 attached to crimped portion 42 of tubular housing portion 43 or other suitable bolt means.

A ferro-metal cover 45 is formed with a top wall 46, sides 47, end wall 48, and end wall 49. Sides 47 are formed with curved edges 50 and 51 and infolded tabs 52 and edges 53 so as to form recesses or cavities 54 and 55, for purposes hereinafter appearing. End wall 49 is formed with a bent lip 56 forming channel 57. Cover 45 is assembled by lip 56 engaging edges 28 so as to hold the cover to element 16. With cover 45 engaging element 16, the wearer pulls trouser flap 15 over trouser flap 14. Wall 59 of housing 36 abuts the inside 62 of wall 48 and magnet face 60 is facingly disposed to ferro-metallic surface 65 of cover top wall 46 (FIG. 3). In this manner the trouser flaps are held in a first closed position.

To adjust the buckle 10 to a second closed position, cover 10 is lifted from surface 60 and the cover and element 17 and trouser flap 15 pulled closer to flap 14 so that housing 36 with magnet 40 is removed from recess 54 with housing wall 59 now abutting tabs 52, with the magnet face 60 opposed to surface 63 of cover top wall 46, so that the cover is magnetically held in the adjusted closed position (FIG. 4).

Referring to FIGS. 7–14, there is shown a second embodiment of the invention, namely buckle 70.

A pair of pants or trousers 71 is shown having waist portion 72 with top free edge 73 and overlapping flaps 74 and 75. Metal attachment elements 76, are in broad terms, constructed of back plates 77 and fastener elements 78. Plates 77 and fastener element 78 are similar in design and construction to plate 17 and fastener element 18 of the embodiment of FIG. 1–6. It is to be noted however that in the latter embodiment there appeared identical pairs of plates 77 and 78 on respective opposed flaps 78 and 75. And when assembled to the flaps the pants in front view have the appearance of central portions 79 with outwardly disposed arms 80 with outermost flanges or prongs 81 formed with angled surfaces 81 and 83, for purposes hereinafter appearing.

A plastic insert 85 is molded or formed of generally H-shaped configuration with a central hub or cross-post 86 and opposed legs 87, forms leg ends **87*a* and 87*b*. Each leg 87 is formed with an arcuately curved top wall 88 and depending rear wall 89. Side walls 90 depend downwardly from top wall 88. Each side wall 90 is formed with a plurality of similarly located, sized and shaped tapered recesses or grooves 91*a*–91*d* and tapered recess or groove 92. It is also noted that side walls 90 and the grooves 91*a*–91*d* and 92 lie in an arcuate curve that parallels the contour of top wall 88. Side wall 90 is formed with tapered end walls 105 and 106**, for purposes hereinafter appearing.

Metal cover 95 is formed with arcuate top wall 96, one side wall 97, end wall 98 with bent lip 99, and end wall portion 100 with lip 101. Cover 95 is arcuately contoured to follow the waistline. Cover 95 may be pre-assembled to insert 85 before pants closure by sliding the cover over the insert 85 so that insert end wall portions **89*a* are lodged within lip 101 and insert end wall portions 89*b* is lodged within bent lip 99 with insert arcuately contoured top wall 88 slidingly engaging the inside 102 of cover top wall 96 until stopped by side wall 97. The metal cover 95 plastic insert 85 assembly is now ready for assembly to the attachment fastener elements 78 for adjustable closure of the pants. Alternatively insert 85 may be assembled to fastener elements 78 and the pants adjustably closed, with metal cover 95 then assembled to the insert as shown by arrow A in FIG. 8**.

Figure 13:
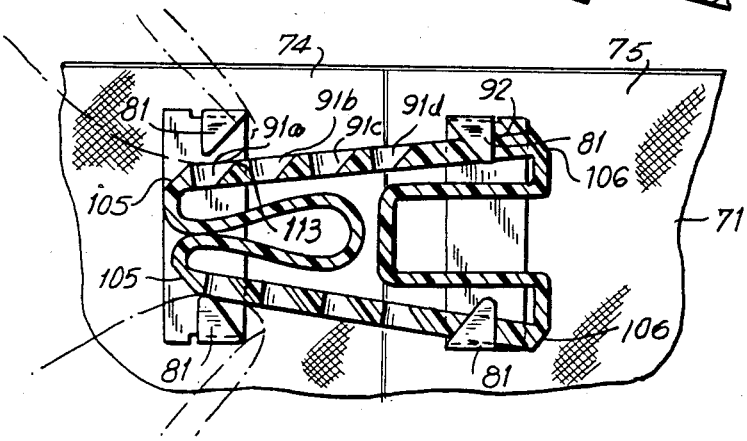
FIG. 13 is a view of the buckle as in FIG. 10, but showing the flexing of the plastic insert for adjusted positioning of the buckle.
Figure 14:
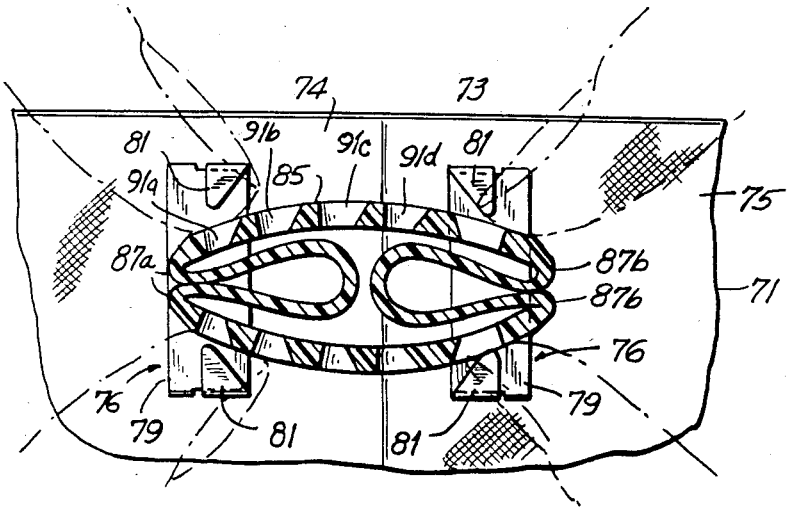
FIG. 14 is a view of the buckle as in FIG. 13 but showing flexing of the insert for removal of the insert from the pants fixed mounting elements on the pants.
Figure 15:
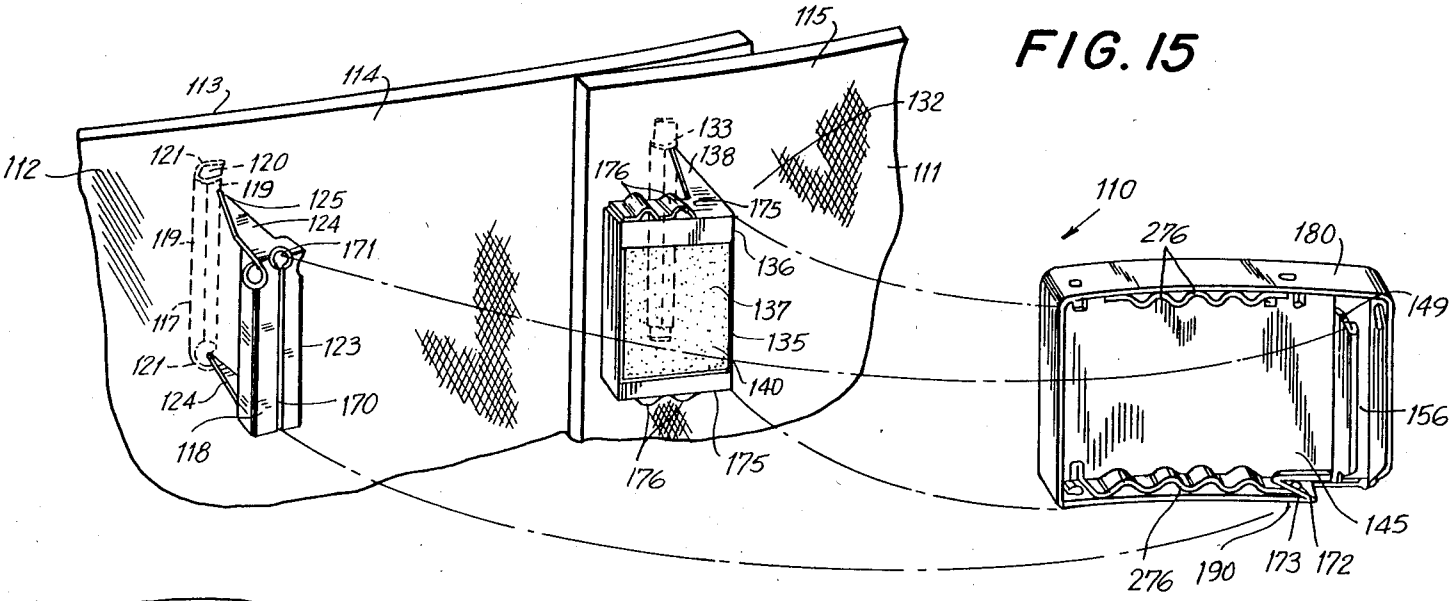
FIG. 15 is a perspective exploded view of the third and most preferred embodiment of the buckle of the present invention assembled to the patns of the wearer.
Figure 16:
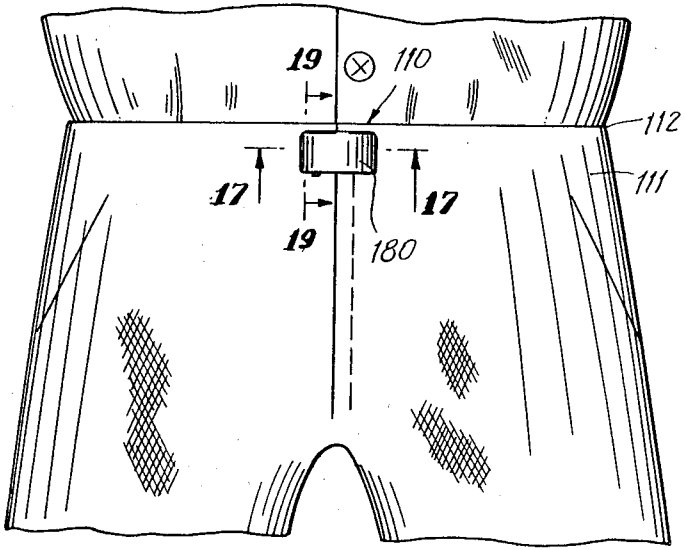
FIG. 16 is a front elevational view of the buckle of FIG. 15 in a closed pants position.
Figure 17:
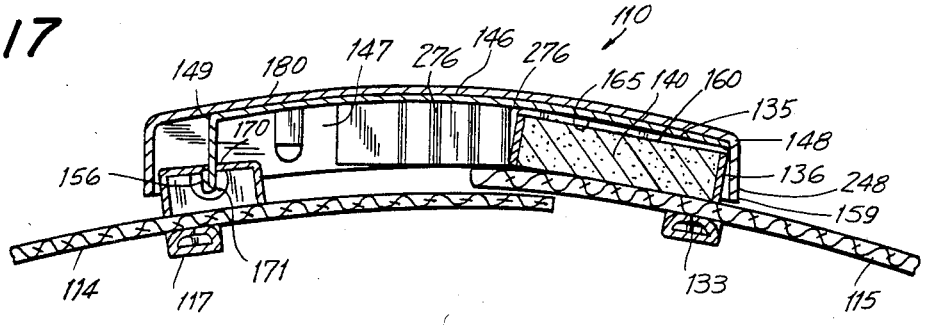
FIG. 17 is an enlarged sectional view taken along line 17—17 of FIG. 16.
Figure 18:
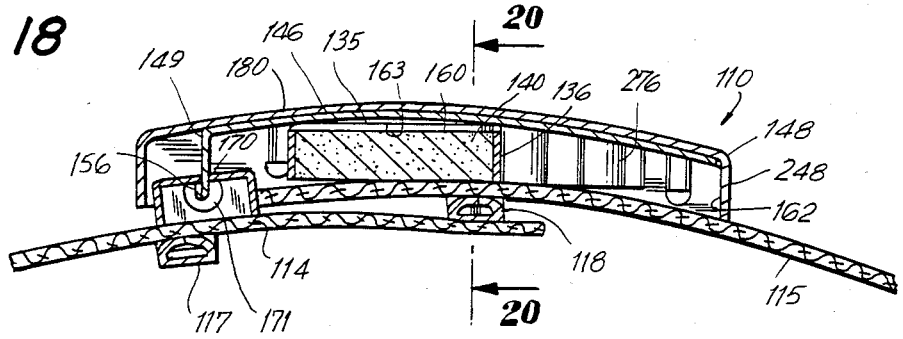
FIG. 18 is a view of the buckle as in FIG. 17 but in an adjusted position.
Figure 19:
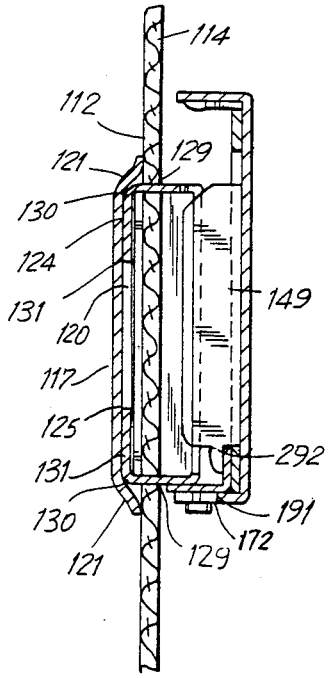
FIG. 19 is an enlarged sectional view taken along line 19—19 of FIG. 16.
Figure 20:
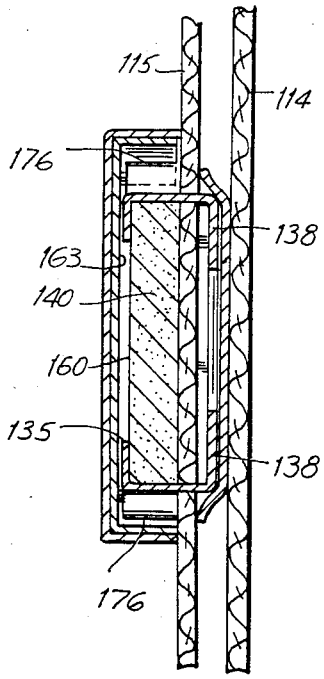
FIG. 20 is a sectional view taken along line 20—20 of FIG. 18.

It is also important to note that insert 85, and particularly post 86 and legs 87 are formed of recessed portions 98 and 94 respectively. In this manner of construction the insert is lightweight and ends **87*a* and 87*b* are flexible as best shown in FIGS. 18 and 14. Of course the flexibility of the insert would also depend upon the choice of plastic, and a broad range of moldable plastics are contemplated, with polyacrylonitriles being preferred. FIGS. 13 and 14** represents the use of a highly flexible plastic.

Figure 10:
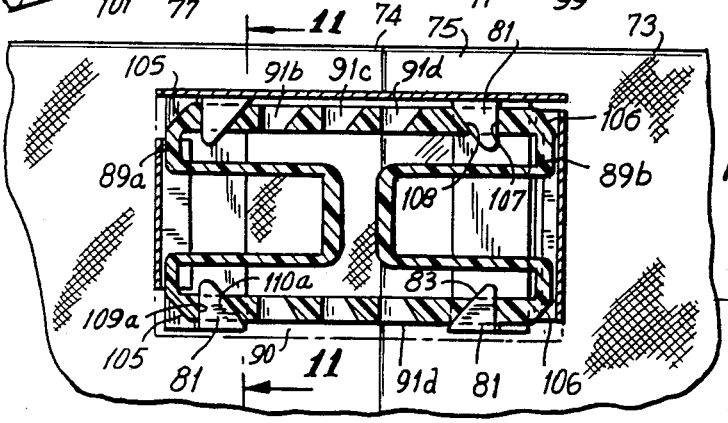
FIG. 10 is a sectional view taken along line 10—10 of FIG. 9.
Figure 12:
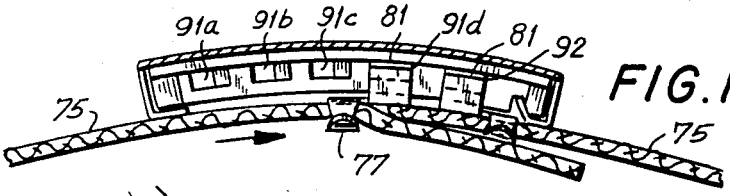
FIG. 12 is a sectional view of the buckle as in FIG. 9 but in another adjusted position.

Insert 85 may be assembled to elements 78 by first squeezing leg ends **87*b* so flanges or prongs 81 can be inserted into recesses 92 so that element wall 82 abuts insert surface 107 and element angled wall 83 abuts tapered surface 108 of recess 92 (FIG. 10). With end 87*b* attached, the insert 85 can be pulled across so that flap 75 overlies flap 74 and element 78 on flap 74 inserted into recess 91*a* so that element wall 82 abuts surface 109*a* and element angled wall 83 abuts surface 110*a*. (FIG. 10). Alternatively, insert 85 may be pulled directly across, without the finger pressing action of FIG. 13, until element angled wall 83 on flap 74 abuts bevelled wall 105 causes self-flexing of legs 87*a* so that the angled wall continues to ride along wall 105 until flange 81 snaps into recess 91*a*. At this point, the buckle closes the pants in the first adjusted position, namely 91*a*. To further tighten the pants, the insert and flap is pulled further in the tightening direction so that angled flange wall 83 slides along surface 110*a* so as to ride out of recess 91*a* and pressingly slidingly engage side wall portion 113 and then snap into recess 91*b*, that is into the second adjusted tightened position. It is of course understood that this buckle adjustment or pants tightening can be accomplished with the metal cover assembled to the insert. By merely pulling the cover, the insert will follow, causing the fastener element flange to snap into and ride out of the successive positions or recesses. The fully tightened position 91*d* is shown in FIG. 12. Positions 91*a*–91*d*** are 2–3 cms. apart.

To loosen the pants, the insert may be squeezed as best shown in FIG. 13 and flap 75 pulled away from flap 74 until the desired position is formed.

To remove the metal cover and plastic insert assembly, cover 95 is slidably removed from the insert and the insert squeezed at both ends **87*a* and 87*b* to release the flanges or prongs 80. It is desirable to remove the cover 95 and insert 85** for cleaning or laundering the pants.

Referring to FIGS. 15–20, there is shown a most preferred embodiment of the present invention, namely, buckle 110.

A pair of pants or trousers 111 is shown having a waist portion 112 having top free edge 113 and overlapping flaps 114 and 115. Metal attachment element 116 is generally formed of a back plate 117 and fastener element 118. Plate 117 is formed with infolded portions 119 forming channel 120 and having oppositely disposed impact plate portions 121. Plate 117 is disposed so that infolded portions 119 are facingly disposed to the inside 112 of flap 114. Fastener element 118 is formed of a flat center member 123 having oppositely disposed downwardly depending tapered flanges 124 with sharp pointed edges 125.

Attachment element 116 is also formed with top slot 170 and contiguous enlarged edge slot 171, for purposes hereinafter appearing.

Attachment element 116 is assembled to flap 114 by driving pointed edges 125 through the flap as at 129 to abut portions 121 so as to cause pointed flanges 124 to bend to a 90° corner as at 130 and reside in channel 120 as at 131, in a manner as previously described.

Cover member 180 is formed with slotted hole 172 at 173, for purposes hereinafter appearing.

Metal attachment element 132 is formed of back plate 133, similar in construction to plate 117, and fastener assembly 135. Assembly 135 is formed of generally rectilinear housing 136 with central portion 137 and depending pointed edged flanges 138. Flanges 138 are similar in design and construction to tapered, pointed flanges 124, so that assembly 135 is mounted to flap 115 with plate 133 in a similar mounting to the mounting of element 118 to flap 114 through plate 117. A permanent magnet 140 is sized to fit into housing 136.

It is important to note that in this embodiment, side walls 176 of housing 136 are formed to provide teeth 176 which extend outwardly from the side walls.

A ferro-metal insert 145 is formed with a top wall 146, sides 147, end wall 148, and end wall 149. Sides 147 are formed with teeth 276 for cooperatively interengaging the teeth 176 in a plurality of positions. End wall 149 is formed with a bent lip 156 which is sized to slidably engage top slot 170 with access through edge slot 171. Insert 145 is assembled by the engaging of the teeth 276 and 176 so as to hold the insert 145 and cover 180 to element 116.

Locking assembly 190 formed of rivet 191 and lock flange 192 are cooperatively mounted in hole 172 and slot 195. In this manner, once lip 156 is in slot 170, rivet 191 is slid in slotted hole 172 so that lock flange 192 blocks at 292 so as to lock lip 156 in place. Other locking mechanisms known in the art are contemplated. With cover 145 engaging element 116, the wearer pulls trouser flap 115 over trouser flap 114. Wall 159 of housing 136 abuts the inside 162 of wall 248 and magnet face 160 is facingly disposed to ferro-metallic surface 165 of insert top wall 146. In this manner the trouser flaps are help in a first closed position.

The non-ferrous cover 180 is formed so as to receive insert 145, and with insert 145 engaging both 132 and 123. Cover 180 provides a finished appearance to the closed trousers.

To adjust the buckle 110 to a second closed position, cover 180 and insert 145 are lifted from surface 160 and the cover and insert 145 with trouser flap 115 are pulled closer to flap 114. Interengaging teeth 276 and 176 are then repositioned with the magnet face 160 opposed to surface 163 of insert top wall 146, so that the insert is magnetically held in the adjusted closed position.

There has thus been shown and described certain buckles of the present invention which provide for adjustable closure of the pants while eliminating the need for belts and fly top button closure, thereby avoiding the undesirable aesthetic aspects of the belts and fly top button closure, while providing a clean, contoured, aesthetically more desired and comfortable closure of pants, trousers, skirts or other garments and constructions.

It is of course understood that various modifications may be made that are within the contemplation of the invention without departing from the scope of the invention as defined in the appended claims.

What is claimed is:

1. An adjustable buckle comprising: a first member comprising means to attach said first member to a first material flap, and having engagement means oppositely disposed from said attachment means and means for effecting engagement with said engagement means at a plurality of positions; said means for effecting engagement comprising a base formed with teeth and a rim formed with teeth to cooperatively engage said base teeth in said plurality of positions; a second member comprising means to attach said second member to a second material flap and having engagement means oppositely disposed from said second attachment means; and a cover formed so as to cover said first member; whereby said first member engages said second member in one of said plurality of positions of said first member so that the buckle secures the flaps in an overlying manner.

2. The adjustable buckle of claim 1, said base further comprising said first means to attach said member.

3. The adjustable buckle of claim 2, said base further including a magnet, and said rim further comprising a top connected therewith, said top being formed of a ferrous metal to facingly contact said magnet in which the first and second members are engaged.

4. The adjustable buckle of claim 3, said first member engagement means being a lip formed in said top and said second member engagement means being a slot formed in said second member.

5. The adjustable buckle of claim 4, further comprising lock means to hold said lip in said slot.

6. The adjustable buckle of claim 1, said cover being formed so as to removable insert said rim.

7. The adjustable buckle of claim 6, said rim insert being U-shaped, with the legs of the U forming two opposed rims having teeth.

8. The adjustable buckle of claim 1, each of said attachment means comprising tapered prongs and recesses for receiving said tapered prongs.

9. The adjustable buckle of claim 1, said plurality of positions being greater than two positions.

* * * * *